US006247757B1

(12) United States Patent
Cochran

(10) Patent No.: US 6,247,757 B1
(45) Date of Patent: Jun. 19, 2001

(54) ROTATABLE IMPLEMENT DEPTH CONTROL APPARATUS

(76) Inventor: Gary Cochran, 3052 N. Forrest Lakes, Wichita, KS (US) 67205

( * ) Notice: Subject to any disclaimer, the term of this patent is extended or adjusted under 35 U.S.C. 154(b) by 0 days.

(21) Appl. No.: 09/205,248

(22) Filed: Dec. 4, 1998

(51) Int. Cl.[7] ..... E01C 23/12

(52) U.S. Cl. ..... 299/39.6; 299/36.1; 299/76; 404/90; 172/78

(58) Field of Search ..... 299/36.1, 39.1, 299/39.3, 39.4, 39.9, 39.6, 76, 78; 37/302; 172/13, 15, 42, 76, 43, 78; 125/13.01, 13.03; 30/390, 391; 404/90

(56) References Cited

U.S. PATENT DOCUMENTS

| | | | | |
|---|---|---|---|---|
| 4,709,736 | * | 12/1987 | Bellars | 144/24.12 |
| 4,891,858 | * | 1/1990 | Wachter | 15/82 |
| 5,259,692 | * | 11/1993 | Beller et al. | 404/90 |
| 5,299,857 | * | 4/1994 | Zanetis | 299/39.1 |
| 5,382,084 | * | 1/1995 | Diver et al. | 299/39.1 |
| 5,775,781 | * | 7/1998 | Sawtelle et al. | 299/39.8 |

OTHER PUBLICATIONS

Melroe company "Pavement Repair with the Bobcat Planer" May 1997.*
ALITEC "Cold Planer" brochure received 2/ 2000.*
ALITEC Planer Press Release Aug. 29, 1995 http:www-w.alitec.com/cold.htm.*
GEHL "Cold Planer" brochure 1995.*
DIGTEC "AP400 Seies II Cold Planer" brochure received Oct. 1991.*

* cited by examiner

*Primary Examiner*—David Bagnell
*Assistant Examiner*—John Kreck
(74) *Attorney, Agent, or Firm*—Kenneth Jack; Davis & Jack, L.L.C.

(57) ABSTRACT

A rotatable implement depth control apparatus consisting of a mounting plate having an upper end, a lower end, a forward face, a rearward face, a right side, a left side, and a lateral axis extending from the right side to the left side, the mounting plate being rotatable about the lateral axis; a rollable trolley, the rollable trolley having a forward end, a rearward end, a right side, and a left side; a rotatable implement carrying frame having a forward end, a rearward end, a right side, and a left side, the forward end of the rotatable implement carrying frame being pivotally attached to the rollable trolley; a rotatable implement having a right side, a left side, and having an axis of rotation extending from the right side to the left side, the rotatable implement being rotatably mounted within the rotatable implement carrying frame; and, a plurality of arms for transferring rotational motion of the mounting plate about the lateral axis to pivotal motion of the frame about the pivotal attachment to the rollable trolley, such arms interlinking the mounting plate and the rotatable implement carrying frame.

13 Claims, 10 Drawing Sheets

ROTATABLE IMPLEMENT DEPTH CONTROL APPARATUS

RELATED PATENT APPLICATION

This patent application is related to the patent application filed Oct. 30, 1998, by inventor, Gary Cochran, entitled Rotatable Implement Depth Control Apparatus, U.S. Patent and Trademark Office Application Ser. No. 09/183,813.

FIELD OF THE INVENTION

This invention relates to surface engaging rotatable chipping, cutting, grinding, milling, planing, and tilling implements. More particularly, this invention relates to such implements which include structure for controlling the depth at which such implements engage the surface.

BACKGROUND OF THE INVENTION

Mobile heavy construction equipment such as tractor backhoes, front loader tractors, excavators, and skid steer loaders commonly are equipped with an hydraulic power system which is capable of supplying power to various hydraulically powered auxiliary implements. In practice, the dirt scooping or dirt moving bucket of a tractor backhoe or excavator may be removed from such tractor backhoe's or excavator's boom arm. Similarly, the lift bucket of a skid steer loader or of a front loader tractor commonly is removable. In place of such dirt working buckets, various auxiliary hydraulically powered implements may be mounted.

Among such auxiliary hydraulically powered implements are implements which rotatably drive wood chipping wheels, blades, drums or discs; implements which rotatably drive concrete cutting wheels, blades, drums or discs; implements which rotatably drive grinding wheels, blades, drums or discs; implements which rotatably drive milling wheels, blades, drums or discs; implements which rotatably drive planing wheels, blades, drums or discs; or implements which rotatably drive tined earth tillers. Such implements, when mounted upon the boom arm, or lift arms, as the case may be, of a tractor backhoe, excavator, front loader tractor, or skid steer loader, are rotatably driven for operative engagement of a surface such as a tree stump, a paved road, and various ground surfaces. In any such application, it is desireable to apply to the implement means for controlling the depth at which the implement engages the surface.

A known depth control means includes an hydraulic ram or a plurality of hydraulic rams installed as a mechanical linkage for selectively raising and lowering the rotatable member with respect to the elevation of the surface to be engaged. Commonly, such hydraulic rams bias between the rotatable member and a frame which rollably or slidably moves along the surface. Also, commonly, such hydraulic rams are configured to bias between a mounting plate attached to the boom arm or lift arms, as the case may be, and a cantilevered support arm which suspends the rotatable member. A problem associated with utilizing such hydraulic rams for depth control is that hydraulic rams are expensive and troublesome to install and maintain, such hydraulic rams are subject to excessive wear and breakage, and such hydraulic rams necessitate an additional hydraulic control which is cumbersome for heavy equipment operators to manipulate.

The instant invention provides a solution to the problems outlined above by eliminating depth control by means of installation of additional hydraulic rams; utilizing a plurality of arms interlinking the mounting plate and the rotatable implement, such arms being adapted for converting rotational motion of the mounting plate to alternate upward and downward motion of the rotatable implement

PRIOR ART PATENTS

U.S. Pat. No. 5,582,490 issued Dec. 10, 1996, to Murray discloses a strip cutter wheel.

U.S. Pat. No. 5,391,017 issued Feb. 21, 1995, to Thomas, et al., discloses a cutting tool for highway use.

U.S. Pat. No. 5,378,081 issued Jan. 3, 1995, to Swisher, Jr., discloses a milling machine with front mounted cutter.

U.S. Pat. No. 5,378,080 issued Jan. 3, 1995, to Dickson, discloses a road surface treating apparatus.

U.S. Pat. No. 5,236,278 issued Aug. 17, 1993, to Dickson, discloses a road surface treating apparatus.

U.S. Pat. No. 5,203,615 issued Apr. 20, 1993, to Zanetis, et al., discloses a side shift system for detachable rotary apparatus.

U.S. Pat. No. 4,516,808 issued May 14, 1985, to Staab, et al., discloses a pavement grinding apparatus.

U.S. Pat. No. 4,909,575 issued Mar. 20, 1990, to Lupton, discloses a road cutting apparatus.

U.S. Pat. No. 5,607,255 issued Mar. 4, 1997, to Thomas, et al., discloses a method of milling highway surfaces.

None of the above disclosed patents teach, disclose, or describe the novel, inventive, useful, and unique aspects, elements, and features of the present inventive rotatable implement depth control apparatus.

BRIEF SUMMARY OF THE INVENTION

A major structural element of a preferred embodiment of the present inventive rotatable implement depth control apparatus comprises a mounting plate having a rearward face and a forward face, the rearward face of the mounting plate preferably being adapted for pivotal attachment to the lift arms and bucket rams of a skid steer loader or front loader tractor; or adapted for pivotal attachment to the singular boom arm and singular bucket ram of a tractor backhoe or excavator. In the preferred embodiment, a pair of rigid extension arms are fixedly welded to the forward face of the mounting plate so that such arms extend forwardly from the lower end of the mounting plate. Above the pair of rigid extension arms, a pair of pivot arms are pivotally mounted so that they extend forwardly from the upper end of the mounting plate, A second major structural element of the preferred embodiment comprises a rollable trolley constructed in the form of a rectangular rolling steel frame. The rollable trolley is preferably pivotally attached to the forward ends of the extension arms, the points of pivotal attachment preferably being positioned upon opposing outwardly facing surfaces of the rollable trolley, and being positioned toward the rear of the roliable trolley.

A third major structural element of the preferred embodiment comprises a rotatable implement suspension frame which is pivotally attached to the rollable trolley, the points of pivotal attachment preferably being at the forward ends of the rotatable implement suspension frame and the rollable trolley. Preferably, the rotatable implement suspension frame is fitted and sized so that, upon pivotal motion of the rotatable implement suspension frame with respect to the rollable trolley, the rotatable implement suspension frame may pass between inwardly facing surfaces of the rollable trolley. Preferably, the rotatable implement suspension frame has a right wall, a left wall, and a curved upper wall which together are configured to form a downwardly opening protective shroud for housing a rotatable implement.

Any of several surface engaging rotatable implements may suitably be rotatably mounted within the rotatable implement carrying frame. Such suitable rotatable implements may be selected from the group of chipping wheels, chipping blades, chipping drums, chipping discs, cutting wheels, cutting blades, cutting drums, cutting discs, grinding wheels, grinding blades, grinding drums, grinding discs, milling wheels, milling blades, milling drums, milling discs, planing wheels, planing blades, planing drums, planing discs, and tined earth tillers. Preferably, the rotatable implement is rotatably mounted within the rotatable implement suspension frame so that its axis of rotation is substantially parallel with the lateral axis of the mounting plate.

Means for rotating the rotatable implement are preferably mounted directly upon the rotatable implement suspension frame. Such means preferably comprises an hydraulic motor which may conveniently be powered by an hydraulic power system which is standard equipment upon heavy construction equipment and machinery. Other suitable rotating means are electric motors and pneumatic motors.

In the preferred embodiment, the forward ends of the pivot arms are preferably pivotally attached to outwardly facing left and right surfaces of the rotatable implement suspension frame, such pivotal attachments being positioned thereon so that upon rotational motion of the mounting plate about its lateral axis, and upon resultant pivotal motion of the extension arms about their pivotal attachments, the pivot arms may alternately raise or lower the rotatable implement suspension frame through its pivotal motion about its pivotal attachments with the rollable trolley.

In operation of the above described preferred embodiment, upon attachment of the mounting plate to the lift arms and bucket rams of, for example, a skid steer loader, and upon extension of such bucket rams, the mounting plate is caused to rotate about its lateral axis while the mounting plate and the extension arms in unison pivot about the extension arm's pivotal attachments to the rollable trolley. Upon such motions, the pivot arms drive the rotatable implement suspension frame downward, such frame pivoting about its forward pivotal attachments with the rollable trolley. Such downward motion of the rotatable implement suspension frame in turn drives downward the rotatable implement mounted therein, adjusting the depth at which such rotatable implement may engage a surface such a road or the ground. Upon selection of a desired depth of engagement through selective rotation and counter-rotation of the mounting plate, the skid steer loader may be driven forwardly while the rotatable implement is rotatably driven, causing the rollable trolley to roll forward, and causing the rotatable implement to engage the surface at the desired depth.

While the embodiment described above is preferred, other structures and configurations within the scope of the invention may suitably serve as the means for converting alternate rotatable motion of the mounting plate to alternate upward and downward motion of the rotatable implement for selective depth control. For example, the pivotal attachments of the rotatable implement suspension frame to the rollable trolley may be repositioned at the rearward ends of such frame and trolley. As another example, the rotatable implement may be directly rotatably mounted upon a pair of arms having rollers on their forward end, the rearward ends of the arms being rigidly welded upon the forwardly facing surface of the mounting plate. As another example, the rollable trolley may be fabricated in a scissor leg frame configuration with arms interlinking the mounting plate and the frame so that alternate rotatable motion of the mounting plate alternately swings the scissor legs toward and away from each other, selectively raising and lowering a rotatable implement mounted within such frame.

Accordingly, it is an object of the present invention to provide a rotatable implement depth control apparatus adapted for pivotal attachment to the lift arms and bucket rams of a skid steer loader or front loader tractor, or to the boom arm and bucket ram of a tractor backhoe or excavator.

It is a further object of the present invention to provide such an apparatus including a mounting plate having structures providing for such pivotal attachments, such mounting plate being rotatable about a lateral axis through actuation of the bucket ram or rams, as the case may be, such apparatus providing mechanical linkages enabling such rotation to selectively raise and lower the rotatable implement.

It is a further object of the present invention to provide such an apparatus which eliminates the necessity of utilization of auxiliary hydraulic rams for depth control of the rotatable implement.

Other and further objects, benefits, and advantages of the present invention will become known to those skilled in the art upon review of the Detailed Description which follows and upon review of the appended drawings.

DETAILED DESCRIPTION OF THE PREFERRED EMBODIMENT

Figure 1:
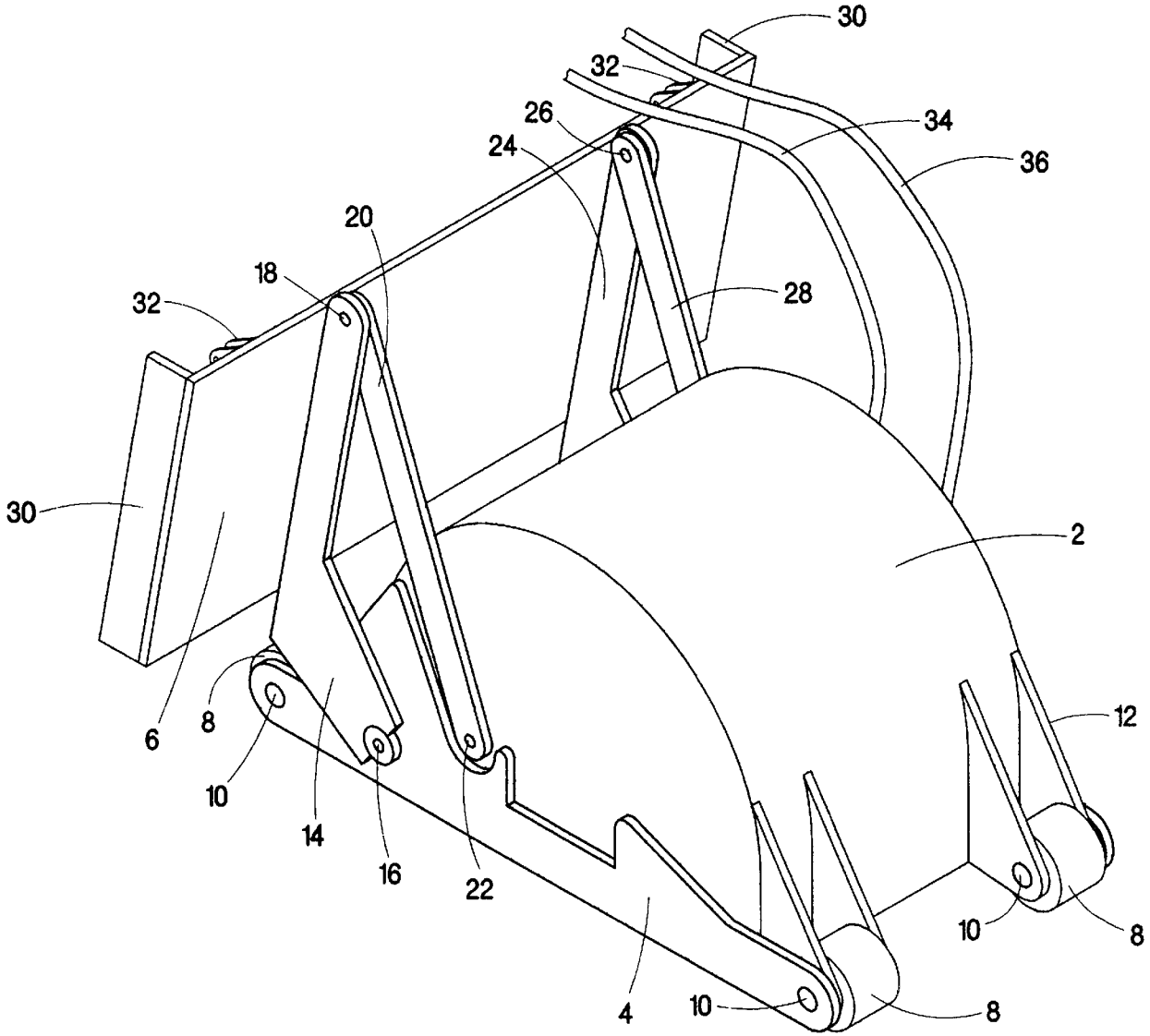
FIG. 1 is an isometric view of a preferred embodiment of the present inventive rotatable implement depth control apparatus.
Figure 2:
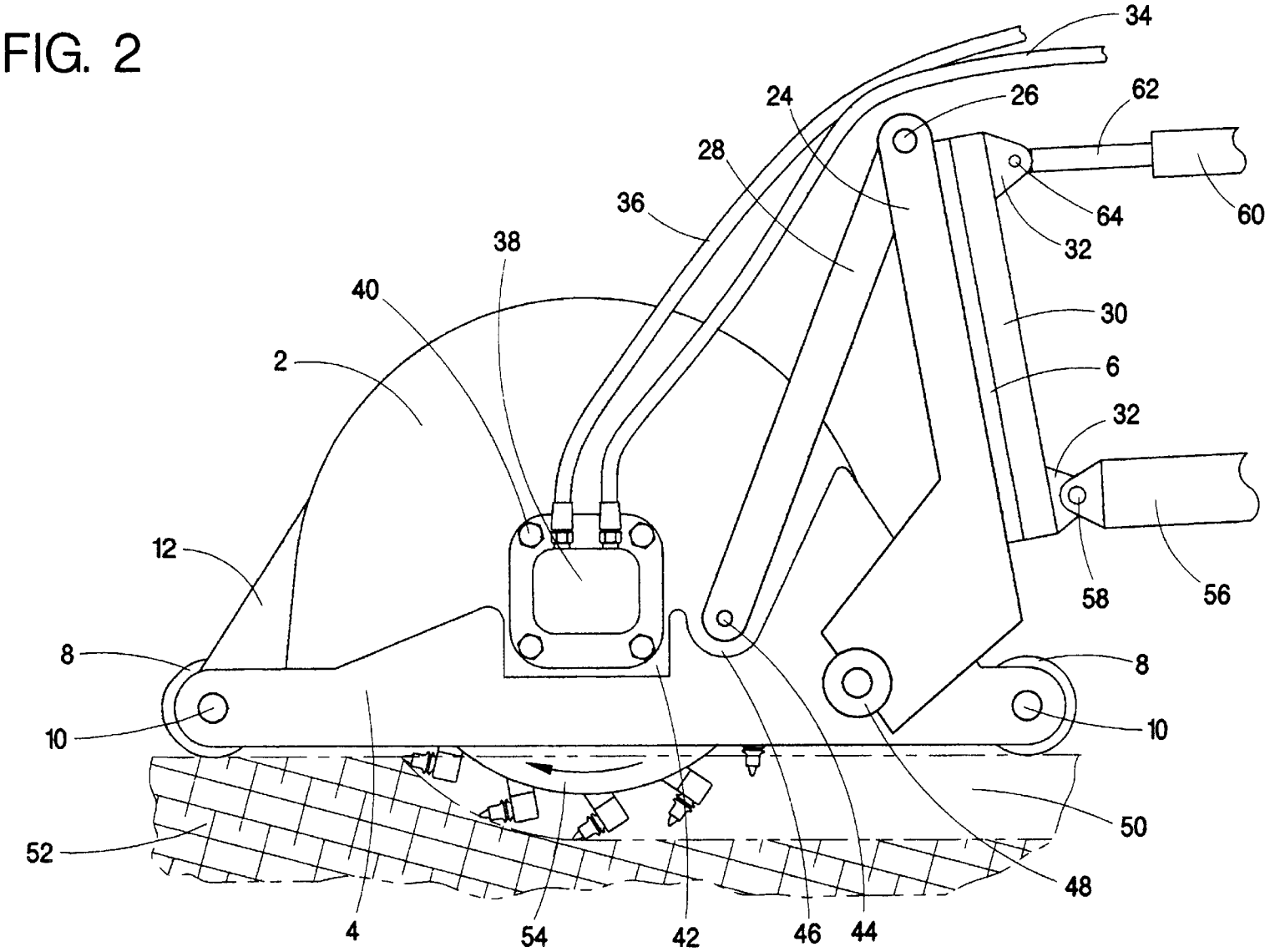
FIG. 2 is a side view of the implement depicted in FIG. 1.

Referring now to the drawings, and in particular, simultaneously to FIGS. 1 and 2, a major structural component of the present invention is a mounting plate 6. The mounting plate 6, as depicted, preferably is a solid sheet of plate steel. The mounting plate 6 may alternately be suitably configured as a rectangular steel frame or grate. The rearwardly facing surface of the mounting plate preferably has fixedly welded thereto device joints 32, the lower of such joints 32 being adapted for pivotal attachment of lift arms 56 of, for example, a skid steer loader by means of swivel pins 58. The upper device joints 32 are similarly pivotally attached to the loader's bucket rams 60 by means of swivel pins 64, such pins interlinking the extension shafts 62 of such rams 60. Where the mounting plate 6 is adapted for attachment to a single boom arm and bucket: ram of a tractor backhoe or excavator, the lateral dimension of the mounting plate 6 is preferably shortened. Reinforcement flanges 30 are preferably fixedly welded to the far left and right edges of the mounting plate 60 for additional structural rigidity.

Referring to FIG. 2, a second major structural element of the apparatus is a rotatable surface engaging implement which is depicted as a cutting drum 54. Other rotatable implements which may be suitably utilized are chipping wheels, chipping blades chipping drums, chipping discs, cutting wheels, cutting blades, cutting discs, grinding wheels, grinding blades, grinding drums, grinding discs, milling wheels, milling blades, milling drums, milling discs, planing wheels, planing blades, planing drums, planing discs, and tined earth tillers.

Referring further to FIG. 2, structural members interlinking the mounting plate 6 and the cutting drum 54 preferably comprise a means for converting rotational motion of the mounting plate 6 about its lateral axis into alternate upward and downward motion of the cutting drum 54 for selective adjustment of the depth at which the cutting drum 54 engages the, for example, paved road 52, selectively varying the depth of the channel 50.

As depicted in the embodiment of FIGS. 1 and 2, the structural members making up said motion transferring means comprise a right extension arm 14, a left extension arm 24, a right pivot arm 20, a left pivot arm 28, a rollable trolley 4, and a rotatable implement suspension frame 2. Preferably, rearward ends of the left and right extension arms 14 and 24 extend upwardly to form flanges for pivotal mounts 18 and 26 of the rearward ends of pivot arms 20 and 28. Preferably, the forward ends of the extension arms 14 and 24 are pivotally attached to the outwardly facing side walls of the rollable trolley 4 by means of swivel pins 16 and 48.

Referring further to FIGS. 1 and 2, the rotatable implement suspension frame 2 is configured as a protective shroud having a pair of vertically oriented side walls and a curved upper wall. Preferably, the forward ends of the pivot arms 20 and 28 are pivotally mounted upon the side walls of the rotatable implement carrying frame 2 by means of swivel pins 22 and 44.

As depicted in FIG. 2, the forward end of the rotatable implement suspension frame 2 is pivotally mounted upon the forward end of the rollable trolley 4 by means of axle pins 10, which axle pins also rotatably mount rollers 8. Flanges 12 fixedly welded to the forwardly facing surface of the rotatable implement carrying frame 2 facilitate such pivotal mounting of the rotatable implement suspension frame and rotatable mounting of rollers 8. Rollers are similarly rotatably mounted upon the rearward end of the rollable trolley.

Referring further to FIG. 2, upon extension of the shafts 62 of the bucket rams 60, the mounting plate 6 rotates about its lateral axis while, referring simultaneously to FIGS. 1 and 2, extension arms 14 and 24 pivot about their pivotal attachments 16 and 48. Such rotational motion of the mounting plate 6 in combination with pivotal motion of the extension arms 14 and 24 drives pivot arms 20 and 28 downward. Such downward motion of the pivot arms 20 and 28 causes the rotatable implement suspension frame 2 to pivot counter-clockwise about its forward pivotal attachments, driving the rotatable implement suspension frame 2 and the cutting drum 54 downward.

Referring to FIG. 2, the rollable trolley 4 preferably has motor receiving indentations 42 and pivot arm receiving indentations 46 preventing the motor 38 and the, referring simultaneously to FIGS. 1 and 2, the forward ends of the pivot arms 20 and 28 from coming into contact with the rollable trolley 4, The motor 38 is preferably hydraulic and is preferably fixedly mounted upon the side wall of the rotatable implement suspension frame 2 by means of bolts 40. The hydraulic motor 38 is preferably powered by hydraulic fluid flow from hydraulic lines 36 and 34.

Referring simultaneously to FIGS. 1 and 2, in operation of the apparatus there depicted, retraction of hydraulic rams 60 raises cutting drum 54 while extension of hydraulic rams 60 lowers cutting drum 54. Through selective extension and retraction of hydraulic rams 60, the depth of the channel 50 cut through the road 52 may be selectively adjusted.

Figure 3:
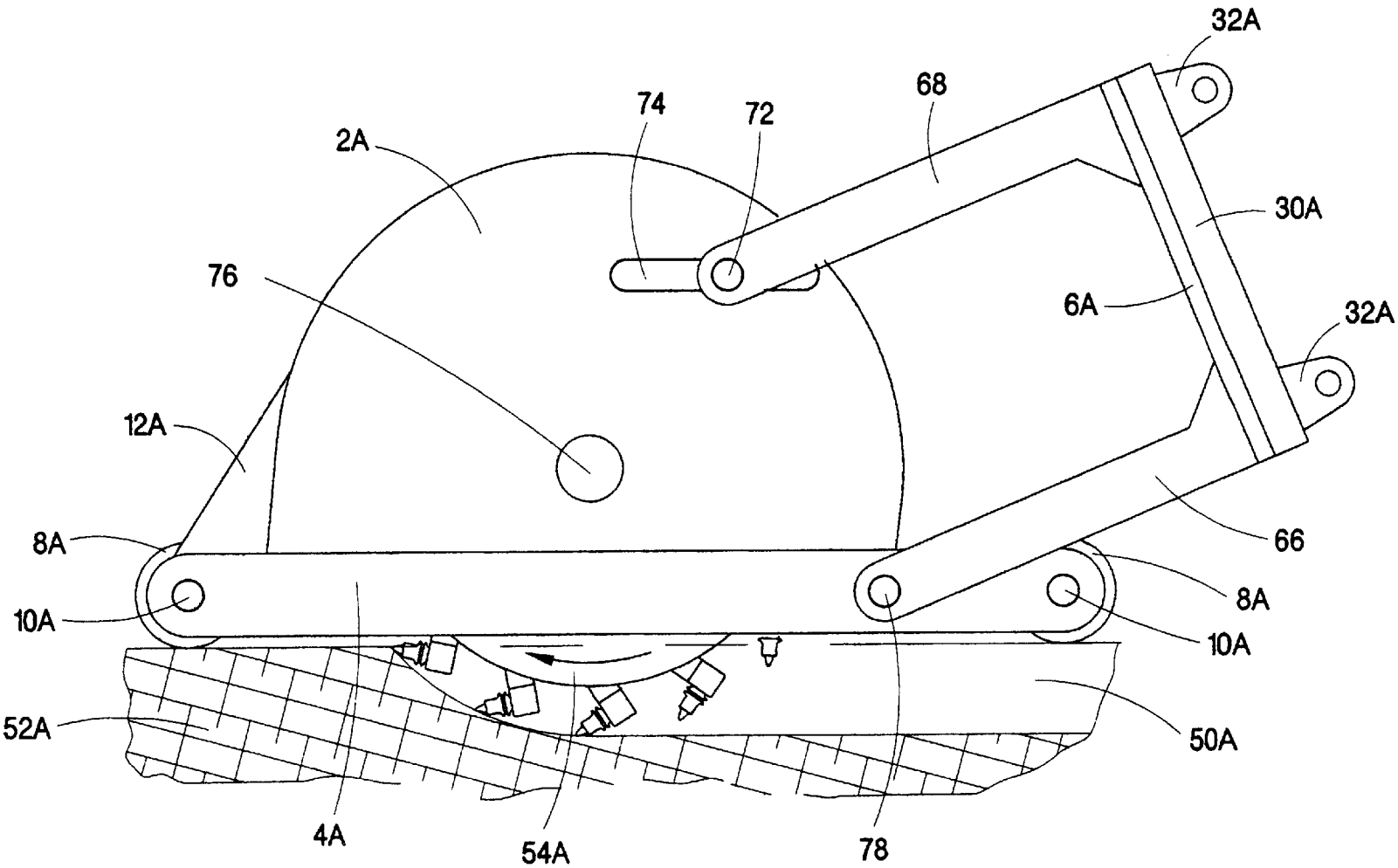
FIG. 3 is a side view of an alternate configuration of the present inventive rotatable implement depth control apparatus.

Numerous other means of converting alternate rotational and counter-rotational motion of the mounting plate 6 into alternate upward and downward motion of the rotatable implement fall within the scope of the present invention. For example, referring to FIG. 3, elements labeled with reference numerals bearing the suffix "A" are substantially identically configured with similarly numbered elements appearing in other drawings. Referring simultaneously to FIGS. 2 and 3, the hydraulic motor 38 has been removed for clarity of depiction, exposing an end of the axle 76 of the grinding drum 54 and 54A. In operation of the alternately configured apparatus depicted in FIG. 3, arms 68 and 66 are rigidly welded to the mounting plate 6A so that rotation of the mounting plate 6A about its lateral axis identically moves swivel pins 72 with respect to swivel pins 78. Upon such motion of swivel pins 72 with respect to swivel pins 78, swivel pins 72 alternately slide forwardly and rearwardly within slots 74, alternately raising and lowering the cutting drum 54A.

Figure 4:
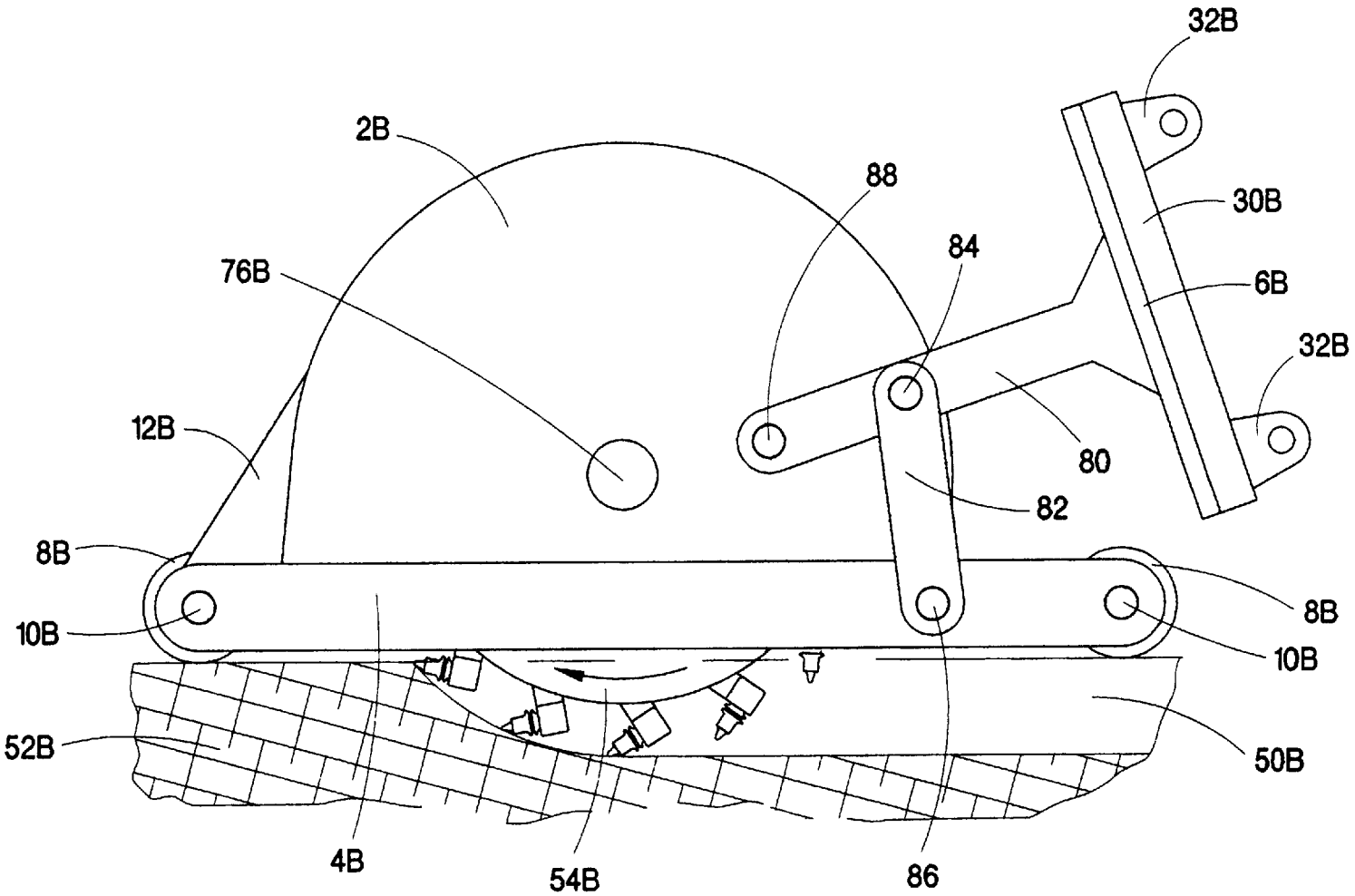
FIG. 4 is a side view of a second alternate configuration of the present inventive rotatable implement depth control apparatus.

As a further example, referring to the alternate configuration depicted in FIG. 4, elements labeled with reference numerals ending with the suffix "B" are substantially identical to similarly numbered elements appearing in other drawings. In operation of the alternately configured apparatus depicted in FIG. 4, rotation of the mounting plate 6B about its lateral axis pivots rigidly attached arms 80 about their pivotal attachments 84, with pivot arms 82, while the pivot arms 82 pivotally move about their pivotal attachments 86 with the rollable trolley 4B. Such pivotal and rotational motion in turn raises and lowers pivotal attachments 88, alternately raising and lowering the grinding drum 54B.

Figure 5:
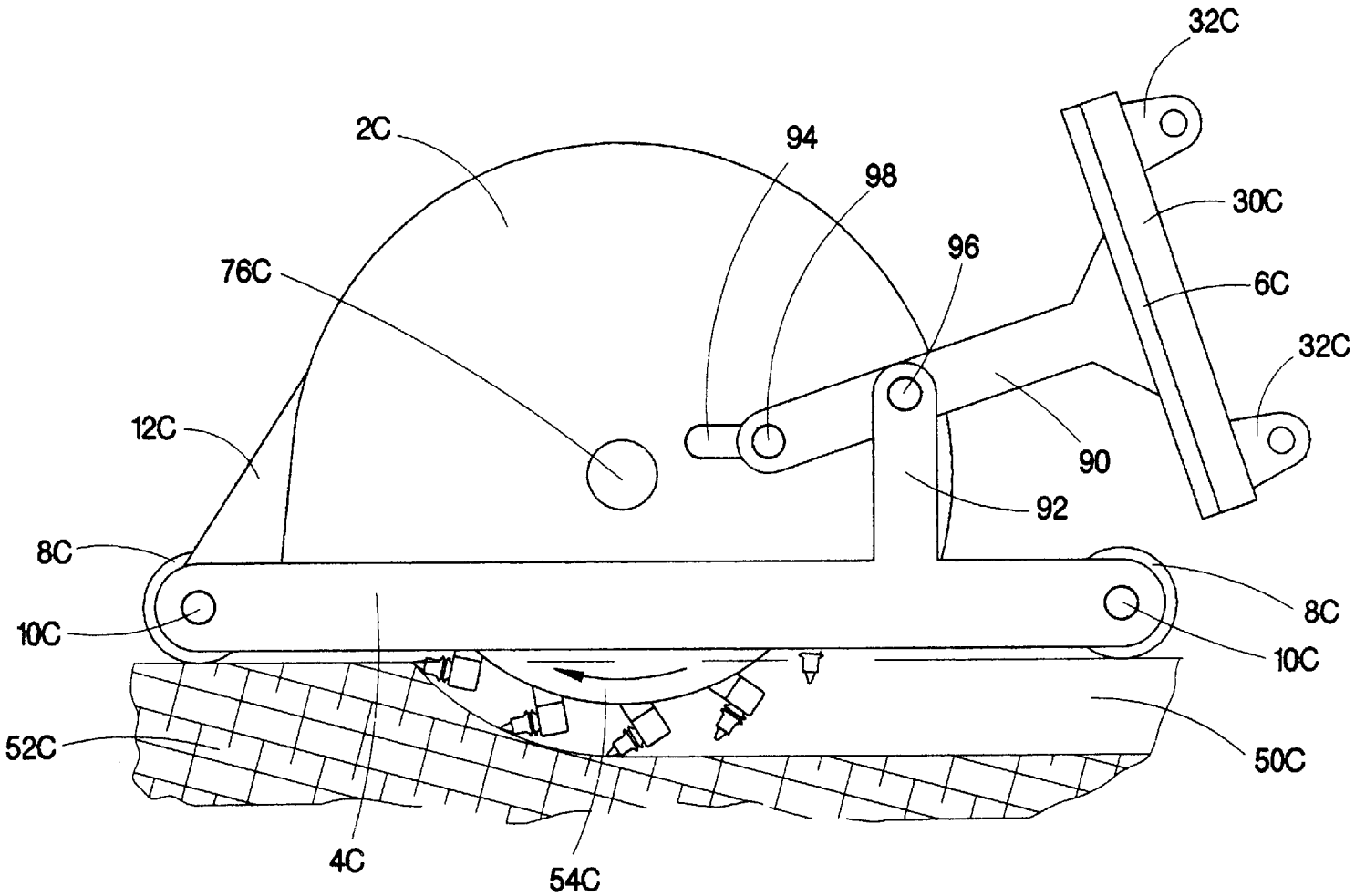
FIG. 5 is a side view of a third alternate configuration of the present inventive rotatable implement depth control apparatus.

As a further example, referring to the alternately configured apparatus depicted in FIG. 5, elements labeled with reference numerals ending with the suffix "C" are substantially identical to similarly numbered elements appearing in other drawings. In operation of the apparatus depicted in FIG. 5, rotational motion of the mounting plate 6C about its lateral axis rotates rigidly attached arms 90 about swivel pins 96 mounted at the upper ends of rigid fulcrum arms 92. Such rotational motion causes swivel pins 96 mounted at the forward ends of rigid arms 90 to slide along slots 94, alternately raising and lowering the grinding drum 54C.

Figure 6:
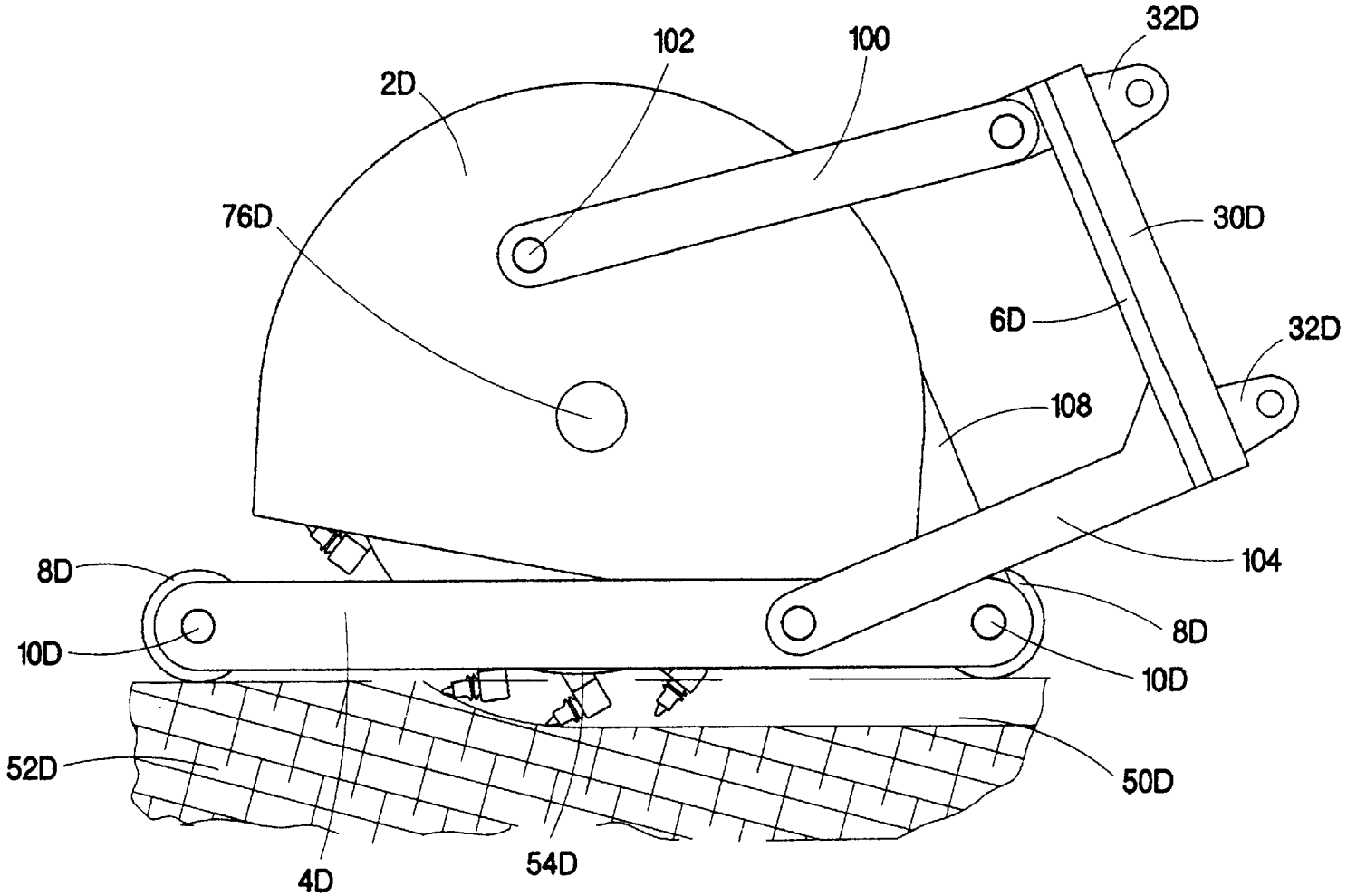
FIG. 6 is a side view of a fourth alternate configuration of the present inventive rotatable implement depth control apparatus.

As a further example, referring to the alternate configuration depicted in FIG. 6, elements labeled with reference numerals ending with the suffix "D" are substantially identical to similarly numbered elements appearing in other drawings. In operation of the apparatus depicted in FIG. 6, rotation of the mounting plate 6D about its lateral axis simultaneously pivots rigid arms 104 about their pivotal attachments resulting in application of alternate driving and pulling forces to pivot arms 100 and their pivotal attachments 102 with the rotatable implement suspending frame 2D. Such alternate driving and pulling forces alternately pivot the frame 2D clockwise and counter-clockwise about its rearward pivotal mounts 108 and 10D, alternately raising and lowering the grinding drum 54D.

Figure 7:
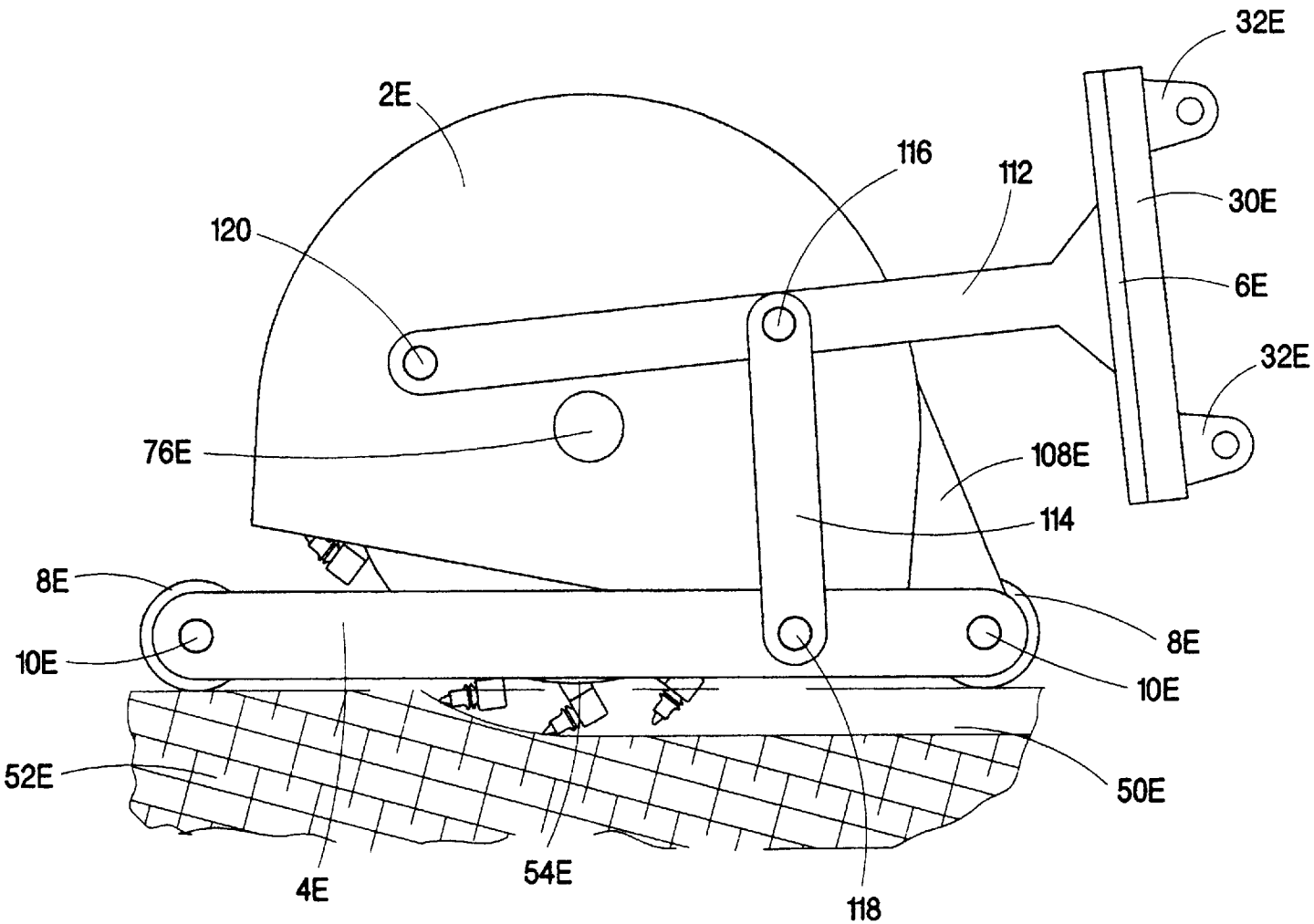
FIG. 7 is a side view of a fifth alternate configuration of the present inventive rotatable implement depth control apparatus.

As a further example, referring to the alternately configured apparatus depicted in FIG. 7, elements labeled with reference numerals having the suffix "E" are substantially identical to similarly numbered elements appearing in other drawings. In operation of the apparatus depicted in FIG. 7, upon rotation of the mounting plate 6E about its lateral axis, rigid arms 112 rotate about swivel pins 116 while pivot arms 114 pivot about swivel pins 118. Such rotating and pivoting motion alternately raises and lowers the pivotal attachment 120 of the rigid arm 112 with the rotatable implement suspension frame 2E, pivoting such frame about its rearward pivotal mount 108E and 10E, alternately raising and lowering the grinding drum 54E.

Figure 8:
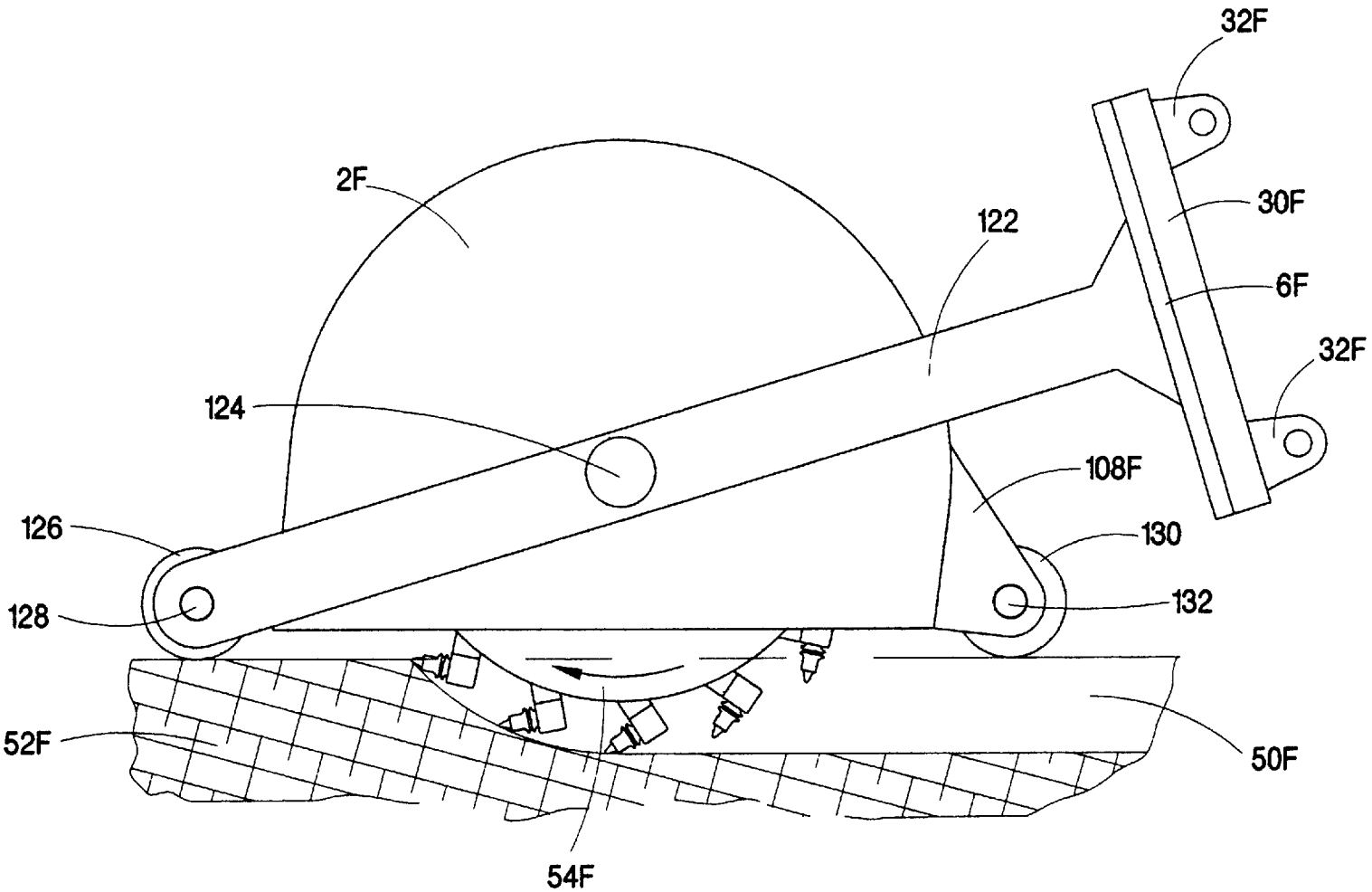
FIG. 8 is a side view of a sixth alternate configuration of the present inventive rotatable implement depth control apparatus.

As a further example, referring to the alternately configured apparatus depicted in FIG. 8, elements labeled with reference numerals having the suffix "F" are substantially identical to elements similarly numbered in other drawings In operation of the apparatus depicted in FIG. 8, upon rotation of the mounting plate 6F about its lateral axis, rigid arms 122 pivots about a forward wheel 126, the forward wheel 126 being rotatably mounted upon the forward ends of the rigid arms 122 by an axle 128. Such pivotal motion alternately raises and lowers the grinding drum 54F whose axle 124 is directly rotatably mounted upon the rigid arms 122. As the grinding drum 54 is forwardly driven through the road 52F, rear wheels 130 rotatably mounted upon axles 132 at the rearward end of the shroud frame 2F roll along the road surface preventing counter-rotation of the shroud frame 2F.

Figure 9:
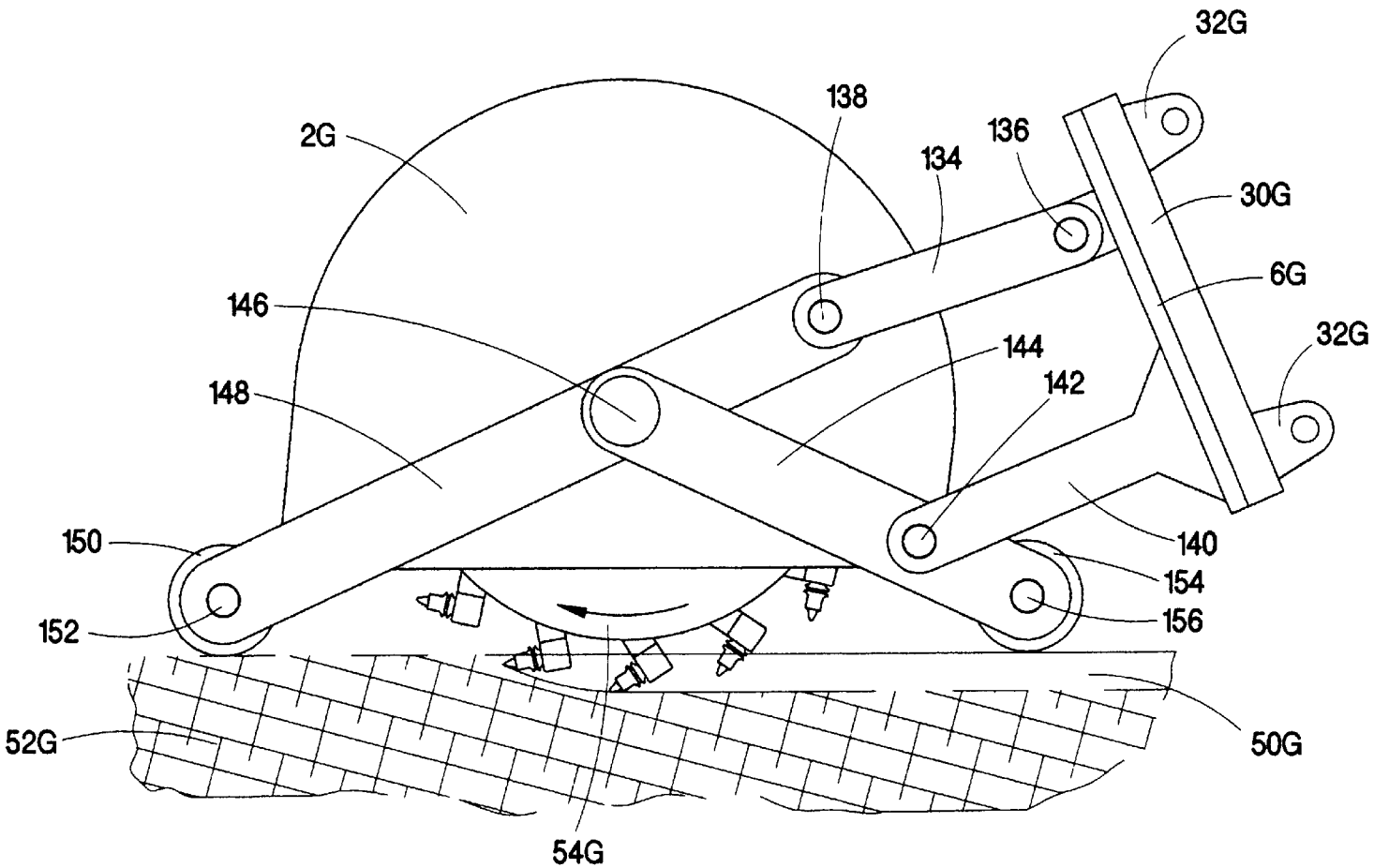
FIG. 9 is a side view of a seventh alternate configuration of the present inventive rotatable implement depth control apparatus.

As a further example, referring to the alternately configured apparatus depicted in FIG. 9, elements labeled with reference numerals ending with the suffix "G" are substantially identical to similarly numbered elements appearing in other drawings. In operation of the apparatus depicted in FIG. 9, upon rotation of the mounting plate 6G about its lateral axis, rigid arms 140 pivot about their pivotal attachments 142 with rear scissor legs 144. Simultaneously, such rotatable motion of the mounting plate 6G applies either a pulling or pushing force to pivot arms 134 through their rear pivotal attachments 136. Such pulling or pushing force is transferred to forward scissor legs 148 through swivel attachments 138. Such pulling or pushing force, in combination with the actions of the rigid arms 140 upon the rear scissor legs 144 alternately swing the scissor legs 148 and 144 toward and away from each other, alternately raising and lowering the axle 146 of the grinding drum 54G, and alternately raising and lowering the grinding drum 54G. Rollers 150 and 154 are respectively rotatably mounted upon the forward ends of the forward scissor legs 148, and upon the rearward ends of the rear scissor leg 144 by means of axle pins 152 and 156.

Figure 10:
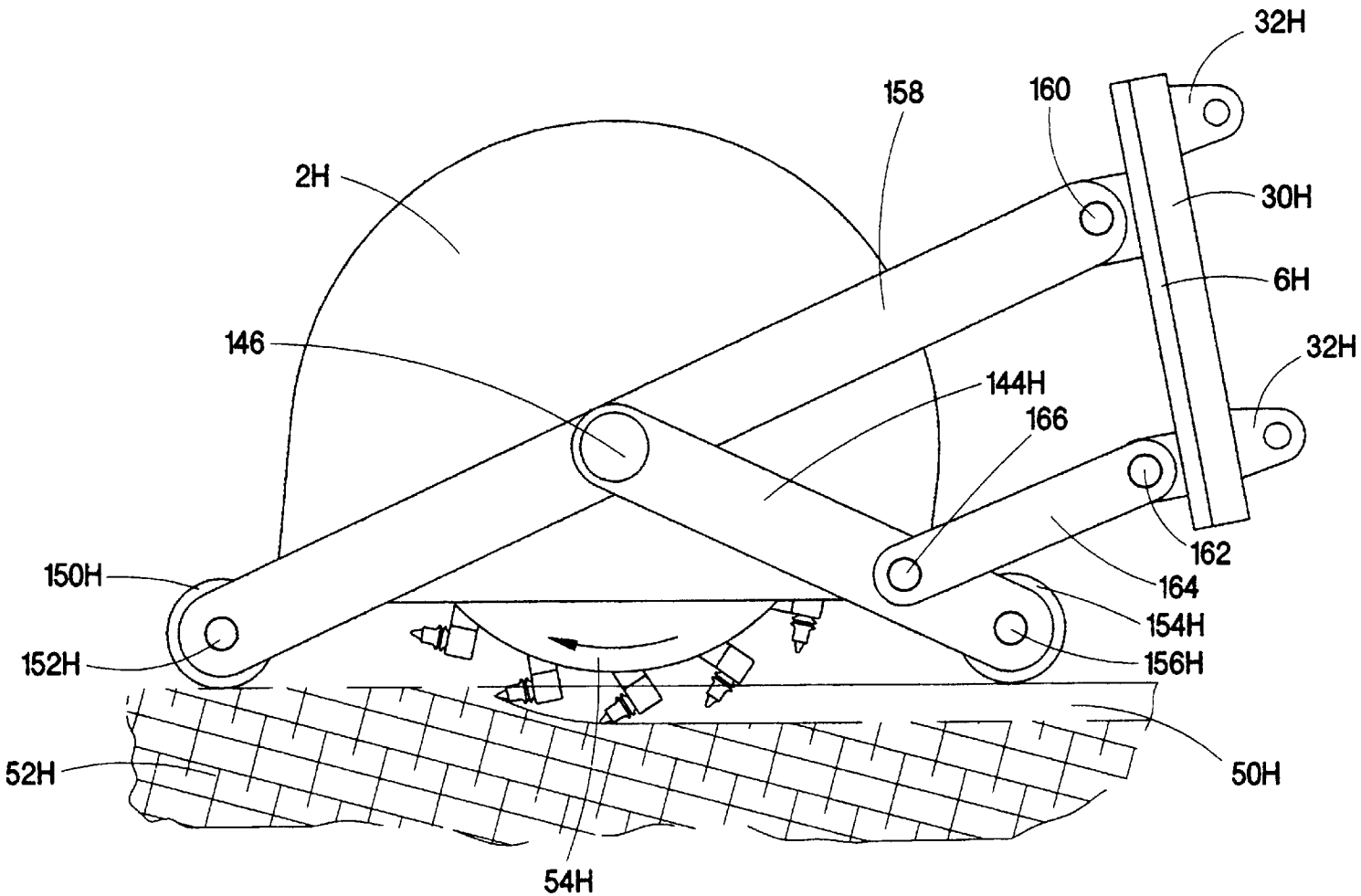
FIG. 10 is an side view of an eighth alternate configuration of the present inventive rotatable implement depth control apparatus.

As a further example of means for converting rotational motion of the mounting plate into elevational positioning of the rotatable implement, referring to the alternately configured apparatus of FIG. 10, elements labeled with reference numerals having the suffix "H" are substantially identical to similarly numbered elements appearing in other drawings. In operation of the apparatus depicted in FIG. 10, upon rotation of the mounting plate 6H about its lateral axis, a pulling or pushing force is applied to forward scissor legs 158 through swivel pins 160 while an opposing pulling or pushing force is applied to pivot arms 164 through swivel pins 162. The forward ends of pivot arms 164 are pivotally attached to the rear scissor legs 144H by swivel pins 166. Such opposing pulling and pushing forces alternately swing the rear scissor legs 144H and the lower end of the forward scissor legs 158 toward and away from each other, alternately raising and lowering the axle 146 of the grinding drum 54H, and alternately raising and lowering the grinding drum 54H.

While the principles of the invention have been made clear in the above illustrative embodiments, those skilled in the art may make further modifications in the structure, arrangement, portions and components of the invention without departing from those principles Accordingly, it is intended that the description and drawings be interpreted as illustrative and not in the limiting sense, and that the invention be given a scope commensurate with the appended claims.

I claim:

1. A rotatable implement depth control apparatus comprising:

(a) a mounting plate having an upper end, a lower end, a forward face, a rearward face, a right side, a left side, and having a first axis of pivoting motion extending from the right side to the left side, the mounting plate being capable of pivoting about said axis;

(b) a rotatable implement having a second axis of pivotal motion, the rotatable implement being capable of pivoting about said axis;

(c) means for transferring alternate pivoting and counter pivoting motion of the mounting plate about said first axis to alternate pivoting and counter-pivoting motion of the rotatable implement about said second axis, such means interlinking the mounting plate and the rotatable implement.

2. The rotatable implement depth control apparatus of claim 1 wherein the means for transferring pivoting motion comprises an arm extending forwardly from the mounting plate.

3. The rotatable implement depth control apparatus of claim 2 further comprising means for rotating the rotatable implement.

4. The rotatable implement depth control apparatus of claim 3 wherein the means for rotating the rotatable implement is selected from the group of hydraulic motors, electric motors, or pneumatic motors.

5. The rotatable implement depth control apparatus of claim 4 wherein the rotatable implement is selected from the group of chipping wheels, chipping blades, chipping drums, chipping discs, cutting wheels, cutting blades, cutting drums, cutting discs, grinding wheels, grinding blades, grinding drums, grinding discs, milling wheels, milling blades, milling drums, milling discs, planing wheels, planing blades, planing drums, planing discs, or tined earth tillers.

6. A rotatable implement depth control apparatus comprising:

(a) a mounting plate having an upper end, a lower end, a forward face, a rearward face, a right side, a left side, and having a lateral axis extending from the right side to the left side, the mounting plate being rotatable about the lateral axis;

(b) a rollable trolley having a forward end, a rearward end, a right side, and a left side;

(c) a rotatable implement suspension frame having a forward end, a rearward end, a right side, and a left side, the forward end of the rotatable implement suspension frame being pivotally attached to the rollable trolley;

(d) a rotatable implement having a right side, a left side, and having an axis of rotation extending from the right side to the left side, the rotatable implement being rotatably mounted within the rotatable implement suspension frame; and, (e) means for transferring rotational motion of the mounting plate about the lateral axis to pivotal motion of the rotatable implement suspension frame about the pivotal attachment to the rollable trolley, such means interlinking the mounting plate and the rotatable implement suspension frame.

7. The rotatable implement depth control apparatus of claim 6 wherein the means for transferring rotational motion comprises at least a first arm spanning between the mounting plate and the rotatable implement suspension frame.

8. The rotatable implement depth control apparatus of claim 7 wherein the at least a first arm has an end pivotally attached to the rotatable implement suspension frame.

9. The rotatable implement depth control apparatus of claim 8 wherein the at least a first arm has an end rigidly attached to the mounting plate.

10. The rotatable implement depth control apparatus of claim 9 further comprising means for rotating the rotatable implement.

11. The rotatable implement depth control apparatus of claim 10 wherein the means for rotating the rotatable implement is selected from the group of hydraulic motors, electric motors, or pneumatic motors.

12. The rotatable implement depth control apparatus of claim 11 wherein the rotatable implement is selected from the group of chipping wheels, chipping blades, chipping drums, cutting wheels, cutting blades, cutting drums, grinding wheels, grinding blades, grinding drums, milling wheels, milling blades, milling drums, planing wheels, planing blades, planing drums, or tined earth tillers.

13. The rotatable implement depth control apparatus of claim 12 wherein the rotatable implement suspension frame comprises a right wall, a left wall, and an upper wall, such walls being configured to form a downwardly opening protective shroud.

* * * * *